US007654551B2

(12) United States Patent
Page

(10) Patent No.: US 7,654,551 B2
(45) Date of Patent: Feb. 2, 2010

(54) SKID STEER ATTACHMENT SYSTEM

(76) Inventor: James H. Page, 10341 18th Ave., Northeast, Bottineau, ND (US) 58318

( * ) Notice: Subject to any disclaimer, the term of this patent is extended or adjusted under 35 U.S.C. 154(b) by 95 days.

(21) Appl. No.: 11/670,558

(22) Filed: Feb. 2, 2007

(65) Prior Publication Data

US 2008/0187426 A1 Aug. 7, 2008

(51) Int. Cl.
*B60D 1/07* (2006.01)
*B66F 9/10* (2006.01)

(52) U.S. Cl. ..... 280/416.1; 280/901; 280/417; 280/441.2; 414/724; 414/607

(58) Field of Classification Search ..... 280/416.1, 280/901, 417.1, 441.2; 414/724, 607
See application file for complete search history.

(56) References Cited

U.S. PATENT DOCUMENTS 1,012,220 A * 12/1911 Pearson ..... 280/412
3,672,521 A 6/1972 Bauer et al.
3,984,016 A 10/1976 Kuhn
4,445,706 A * 5/1984 Jarosek ..... 172/310
4,478,032 A * 10/1984 Inskeep ..... 56/377
4,738,461 A * 4/1988 Stephenson et al. ..... 280/400
4,811,442 A * 3/1989 Barker ..... 15/82
4,878,713 A * 11/1989 Zanetis ..... 299/39.5
4,892,155 A * 1/1990 Wanamaker ..... 172/199
4,979,359 A * 12/1990 Inskeep ..... 56/14.9
5,097,609 A * 3/1992 Swaggert ..... 37/403
5,388,893 A 2/1995 Maxwell et al.
5,412,929 A * 5/1995 Urbain et al. ..... 56/15.4
5,505,268 A * 4/1996 McPherson et al. ..... 172/123
5,562,398 A 10/1996 Knutson
5,618,155 A * 4/1997 Tighe ..... 414/680
5,725,230 A * 3/1998 Walkup ..... 280/442
5,938,399 A 8/1999 Knutson
6,035,478 A 3/2000 Miller et al.
6,135,701 A * 10/2000 Galloway, Sr. ..... 414/607
6,279,665 B1 8/2001 Devaney
6,283,225 B1 9/2001 Hermonson
6,439,332 B1 8/2002 Meurer
6,487,799 B2 * 12/2002 Burk ..... 37/403
6,497,294 B2 * 12/2002 Vought ..... 172/122
6,499,934 B1 12/2002 Kaczmarski et al.
6,551,050 B1 * 4/2003 Kallevig et al. ..... 414/607
6,578,297 B1 6/2003 Forsberg
6,585,071 B2 * 7/2003 Meurer ..... 180/209
6,619,881 B1 * 9/2003 Harvey ..... 404/107
6,796,762 B2 9/2004 Vicars, III et al.

(Continued)

OTHER PUBLICATIONS

Bobcat Company, "Skidster Loader", <available at http://www.bobcat.com/products/photos.html?item=10929&photo=4&mp=5>.

(Continued)

*Primary Examiner*—Lesley D Morris
*Assistant Examiner*—Marlon A Arce

(57) ABSTRACT

A skid steer attachment system for efficiently increasing the functionality of a skid steer loader. The skid steer attachment system generally includes an attachment assembly to mechanically attach to a skid steer loader, a support frame mechanically attached to the attachment assembly, wherein the support frame is comprised of a U-shaped structure and at least one wheel rotatably attached to the support frame opposite the attachment assembly and wherein the wheel is positionable upon an opposing side of the skid steer loader as the attachment assembly.

19 Claims, 13 Drawing Sheets

U.S. PATENT DOCUMENTS

| | | | | |
|---|---|---|---|---|
| 6,840,334 | B2 | 1/2005 | Marquardt | |
| 6,923,267 | B1 * | 8/2005 | Bentley | 172/22 |
| 6,932,555 | B2 * | 8/2005 | Dale et al. | 414/607 |
| 6,988,451 | B2 * | 1/2006 | Marcotte et al. | 105/215.1 |
| 7,036,252 | B2 | 5/2006 | Haroldsen et al. | |
| 7,334,645 | B2 * | 2/2008 | Stevenson et al. | 172/677 |
| 2001/0027869 | A1 * | 10/2001 | Vought | 172/122 |
| 2004/0146389 | A1 | 7/2004 | Bares et al. | |
| 2006/0210385 | A1 | 9/2006 | Cook | |
| 2007/0068051 | A1 * | 3/2007 | Mills et al. | 37/468 |

OTHER PUBLICATIONS

Bobcat Company, "Compact Track Loaders", <available at http://www.bobcat.com/products/photos.html?10805&photo=2&mp=4>.
Vermeer Manufacturing Company, "Perennial Garden Designer Creates Unique Spaces", http://www.vermeer.com/vcom/CompactEquipment/Index.jsp?NewsID=12758>.
Toro Company, "Dingo 323", <available at http://www.toro.com/professional/sws/loader/wheel/22318.html>.
Deere & Company, "Skid Steers", <available at http://www.deere.com/en_US/cfd/construction/deere_const/skidsteers/deere_skidsteer_selection.html?tm=conus&link=clevel&locati... >.
O'Reilly Industries, "Skid Steer Buckets from Skidworks", <available at http://www.skid-steer-attachments.net/bucket.htm>.
Special Products Company, "Quick Hitches", <available at http://www.speeco.com/asp/display.asp?view=top&category=Quick+Hitches>.
Constructioncomplete, "Miller Scoot-Crete MB13-SR Concrete Buggie", <available at http://www.constructioncomplete.com/ConcreteBuggies/MillerScootCreteMB16SR.html>.
Ausa, "Dumpers 2500-7000 kg Articulated Chassis", <available at http://www.ausa.com/int/S_ficha_categoria.asp?id_categoria=38>.
Bobcat Company, "The Bobcat MT52", <available at http://www.bobcat.com/products/mtl/specifications.html?itemId=4793>.
Patent Cooperation Treaty, International Search Report & Written Opinion of the International Searching Authority, Aug. 25, 2008, PCT/US07/69127, 7 pages.

* cited by examiner

SKID STEER ATTACHMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to skid steer loaders and more specifically it relates to a skid steer attachment system for efficiently increasing the functionality of a skid steer loader.

2. Description of the Related Art

Any discussion of the prior art throughout the specification should in no way be considered as an admission that such prior art is widely known or forms part of common general knowledge in the field.

Skid steer loaders have been in use for years. Typically, skid steer loaders are manufactured in a plurality of various configurations to accomplish and perform various tasks. There are also generally various attachments that attach to the front end or bucket of a skid steer loader, wherein the various attachments generally utilize the quick attach system common in the art of skid steer loaders or utilize bucket slots which is also common in the art of skid steer loaders.

Skid steer attachments have not, however, been affixed in such a way that they are utilized by towing or pulling the attachment by the skid steer loader. It is generally appreciated that vehicles have a much larger towing capacity than carrying capacity, wherein skid steer loaders have been hindered because the skid steer loaders are generally solely capable of carrying a load. Because of the general lack of efficiency and practicality in the prior art there is the need for a new and improved skid steer attachment system for efficiently increasing the functionality of a skid steer loader.

BRIEF SUMMARY OF THE INVENTION

The general purpose of the present invention is to provide a skid steer attachment system that has many of the advantages of the skid steer loaders mentioned heretofore. The invention generally relates to a skid steer loader which includes an attachment assembly to mechanically attach to a skid steer loader, a support frame mechanically attached to the attachment assembly, wherein the support frame is comprised of a U-shaped structure and at least one wheel rotatably attached to the support frame opposite the attachment assembly and wherein the wheel is positionable upon an opposing side of the skid steer loader as the attachment assembly.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a skid steer attachment system for efficiently increasing the functionality of a skid steer loader.

Another object is to provide a skid steer attachment system that increases the load capacity of a skid steer loader by allowing the skid steer loader to transport loads utilizing different methods.

Another object is to provide a skid steer attachment system that may be pulled or towed behind a skid steer loader.

An additional object is to provide a skid steer attachment system that easily attaches to a skid steer loader.

A further object is to provide a skid steer attachment system that is adjustable in size to accommodate various size skid steer loaders.

Another object is to provide a skid steer attachment system that allows the utilization of various other attachment systems with the skid steer loader (i.e. plow, three point hitch, trailer, dump box, etc.).

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
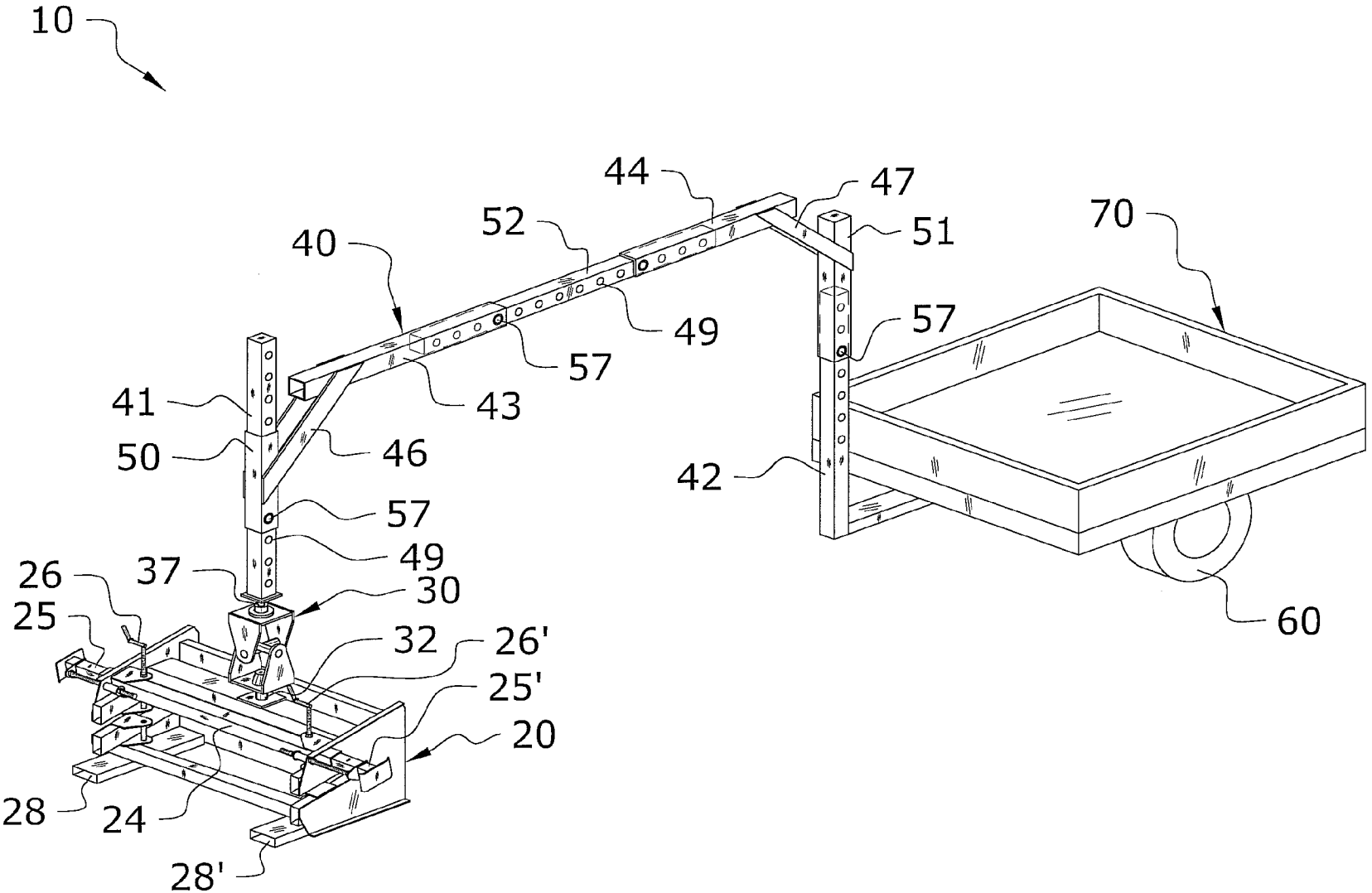
FIG. 1 is an upper perspective view of the present invention.

Turning now descriptively to the drawings, in which similar reference characters denote similar elements throughout the several views, FIGS. 1 through 13 illustrate a skid steer attachment system 10, which comprises an attachment assembly 20 to mechanically attach to a skid steer loader 12, a support frame 40 mechanically attached to the attachment assembly 20, wherein the support frame 40 is comprised of a U-shaped structure and at least one wheel 60 rotatably attached to the support frame 40 opposite the attachment assembly 20 and wherein the wheel 60 is positionable upon an opposing side of the skid steer loader 12 as the attachment assembly 20.

In the following description the skid steer loader 12 is the vehicle utilized with the present invention; however it is appreciated that any suitable vehicle may be utilized with the present invention. It is further appreciated that in certain circumstances the present invention may be utilized without a vehicle.

B. Attachment Assembly

The attachment assembly 20 securely attaches the present invention to the skid steer loader 12 as illustrated in FIGS. 3 through 12. The attachment assembly 20 is preferably comprised of a metal material for added strength; however it is appreciated that the attachment assembly 20 may be comprised of various configurations rather than the preferred embodiment, such as but not limited to plastic. The shape of the attachment assembly 20 is also preferably substantially similar to the shape of a bucket 14 common in the art with standard skid steer loaders 12.

The attachment assembly 20 includes a slot 22, 22' on each opposing side of the attachment assembly 20. The slots 22, 22' preferably extend longitudinally and slightly upward upon each opposing side of the attachment assembly 20 as illustrated in FIGS. 1 through 6. The slots 22, 22' are further preferably substantially similar or slightly greater in diameter than the thickness of a standard bucket 14 upon a skid steer loader 12. The length of the slots 22, 22' are also preferably substantially similar to the depth of the bucket 14.

Figure 2:
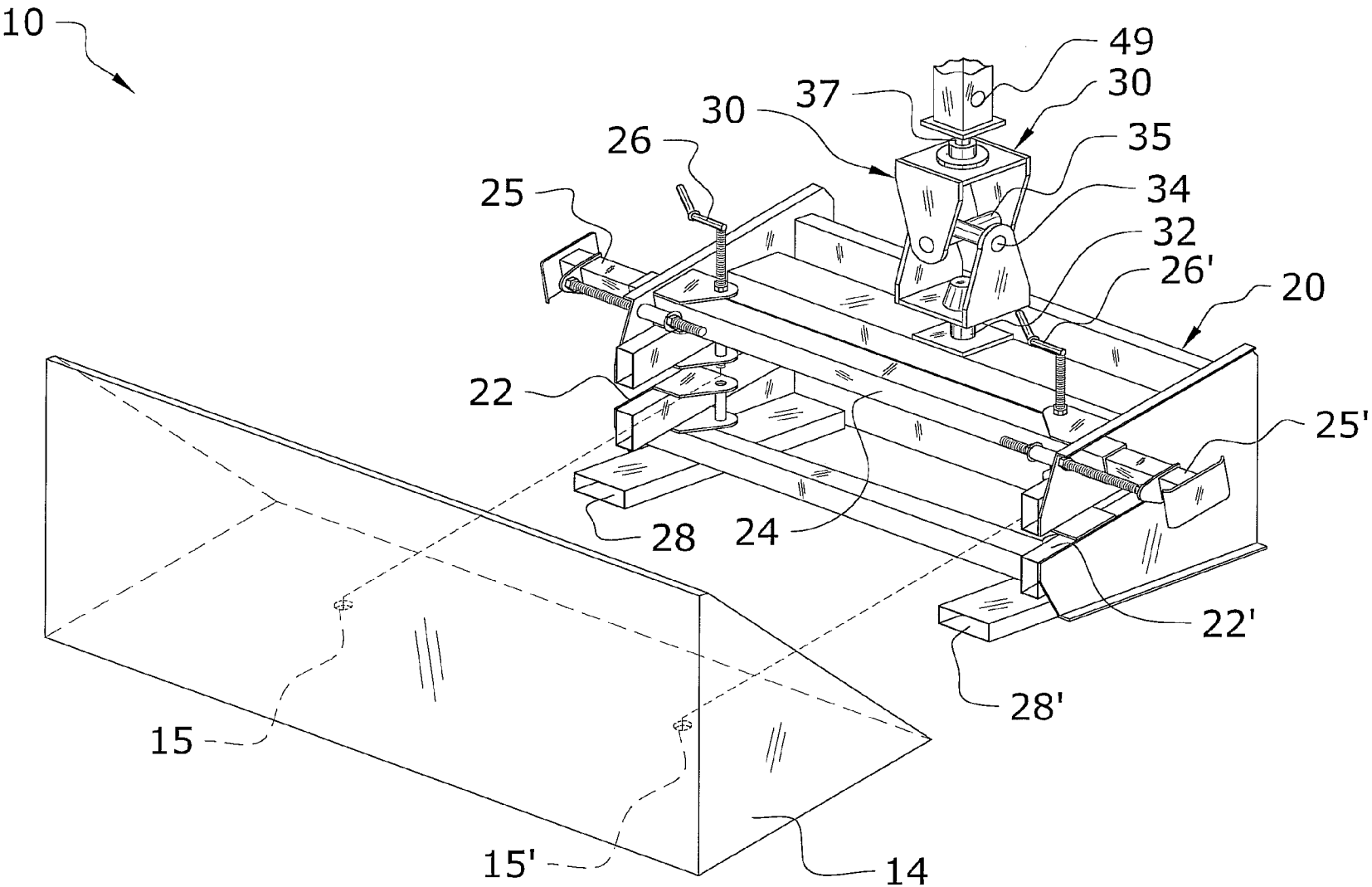
FIG. 2 is an upper perspective view of the attachment assembly attaching to the bucket.

The attachment assembly 20 also preferably includes a cross member 24 extending between opposing sides of the attachment assembly 20. The cross member 24 is preferably comprised of a square tubular configuration as shown in FIGS. 1 and 2. Extending within the cross member 24 are preferably a pair of centering members 25, 25'. Each centering member 25, 25' preferably extends within an opposing side of the cross member 24, wherein the centering members 25, 25' preferably form a telescoping attachment with the cross member 24. The centering members 25, 25' are able to slide in and out of the cross member 24.

The attachment assembly 20 also preferably includes a pair of securing members 26, 26'. The securing members 26, 26' are preferably comprised of a bolt configuration as shown in FIGS. 1 and 2. The securing members 26, 26' are also threadably attached to the attachment assembly 20 and preferably extend through a pair of openings 14 in the bottom of the bucket 14 when the attachment assembly 20 is positioned and centered within the bucket 14. The openings 14 are preferably pre-drilled through the floor of the bucket 14 to align with the securing members 26, 26' when the attachment assembly 20 is centered within the bucket 14. It is appreciated that more or less securing members 26, 26' may be utilized with the present invention than the preferred embodiment.

The attachment assembly 20 includes a channel member 28, 28' on each opposing side of the attachment assembly 20. The channel members 28, 28' preferably extend longitudinally and upon the underside of each opposing side of the attachment assembly 20 as illustrated in FIGS. 1 and 2. The channel members 28, 28' are further preferably substantially similar or slightly greater in diameter than the thickness of a standard fork unit 17 upon a skid steer loader 12. The length of the channel members 28, 28' are also preferably substantially similar or slightly less than the length of the fork units 17 of the skid steer loader 12.

Figure 3:
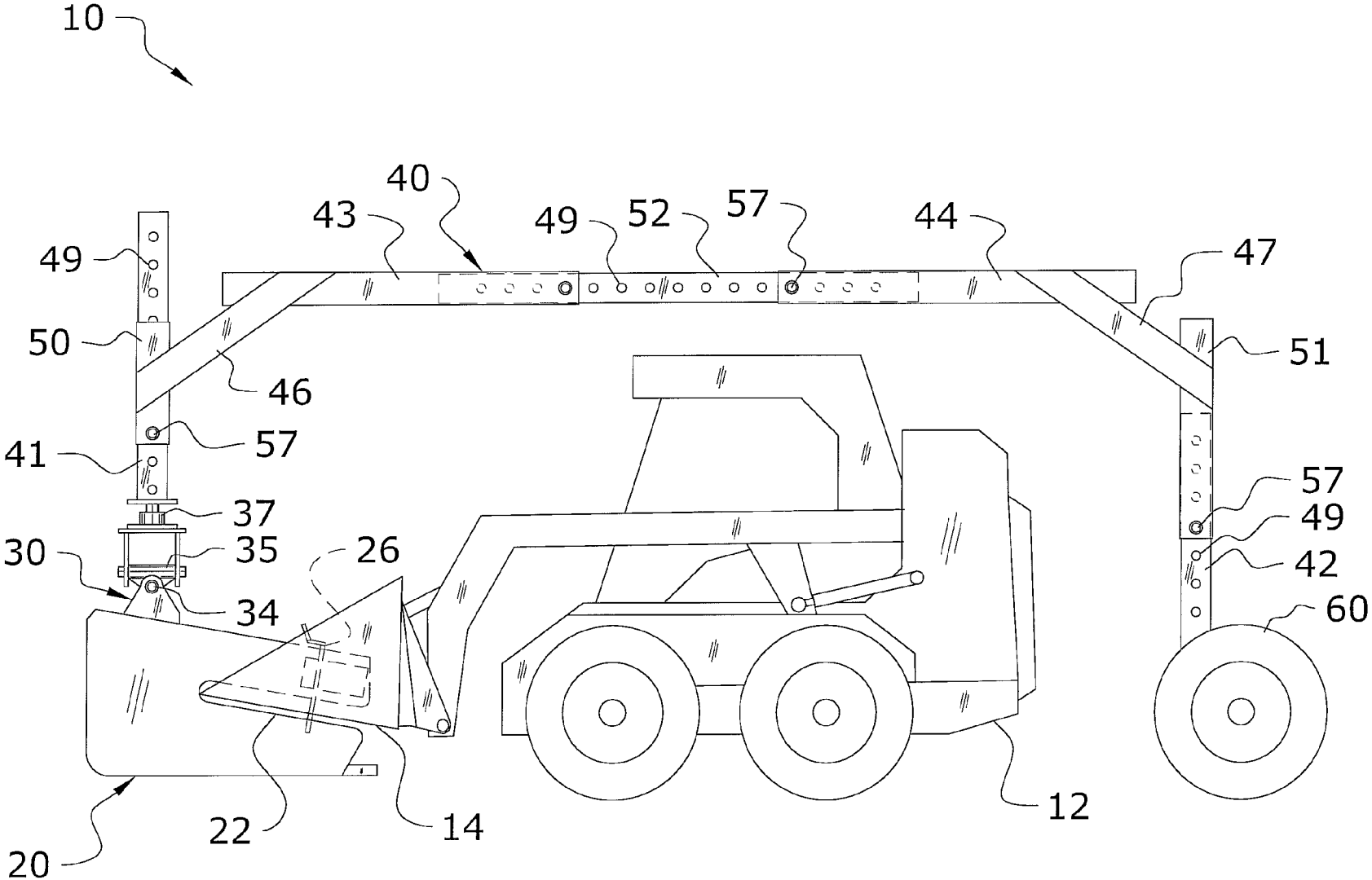
FIG. 3 is a side view of the present invention attached to a skid steer loader utilizing a first method of attachment.
Figure 4:
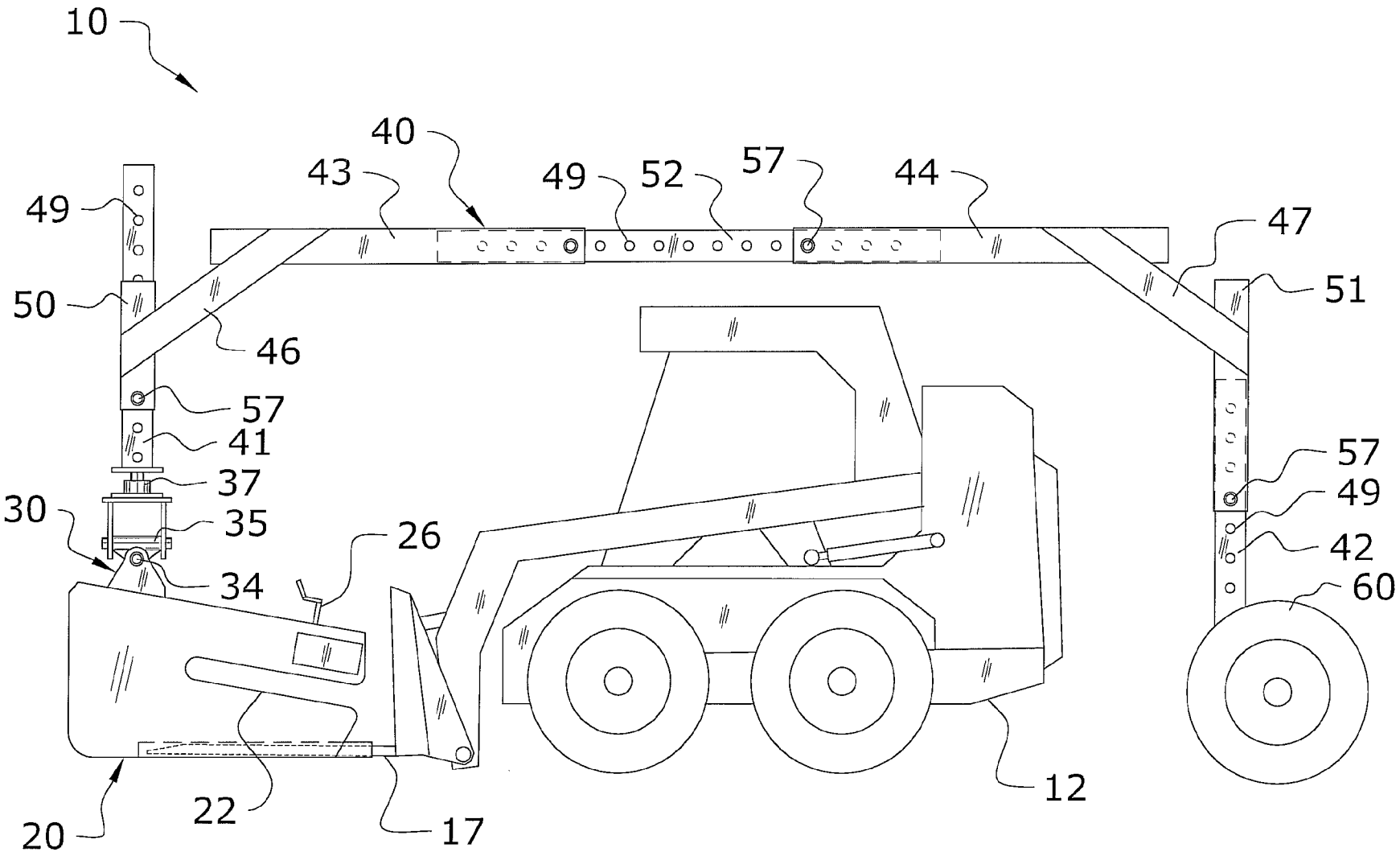
FIG. 4 is a side view of the present invention attached to a skid steer loader utilizing a second method of attachment.
Figure 5:
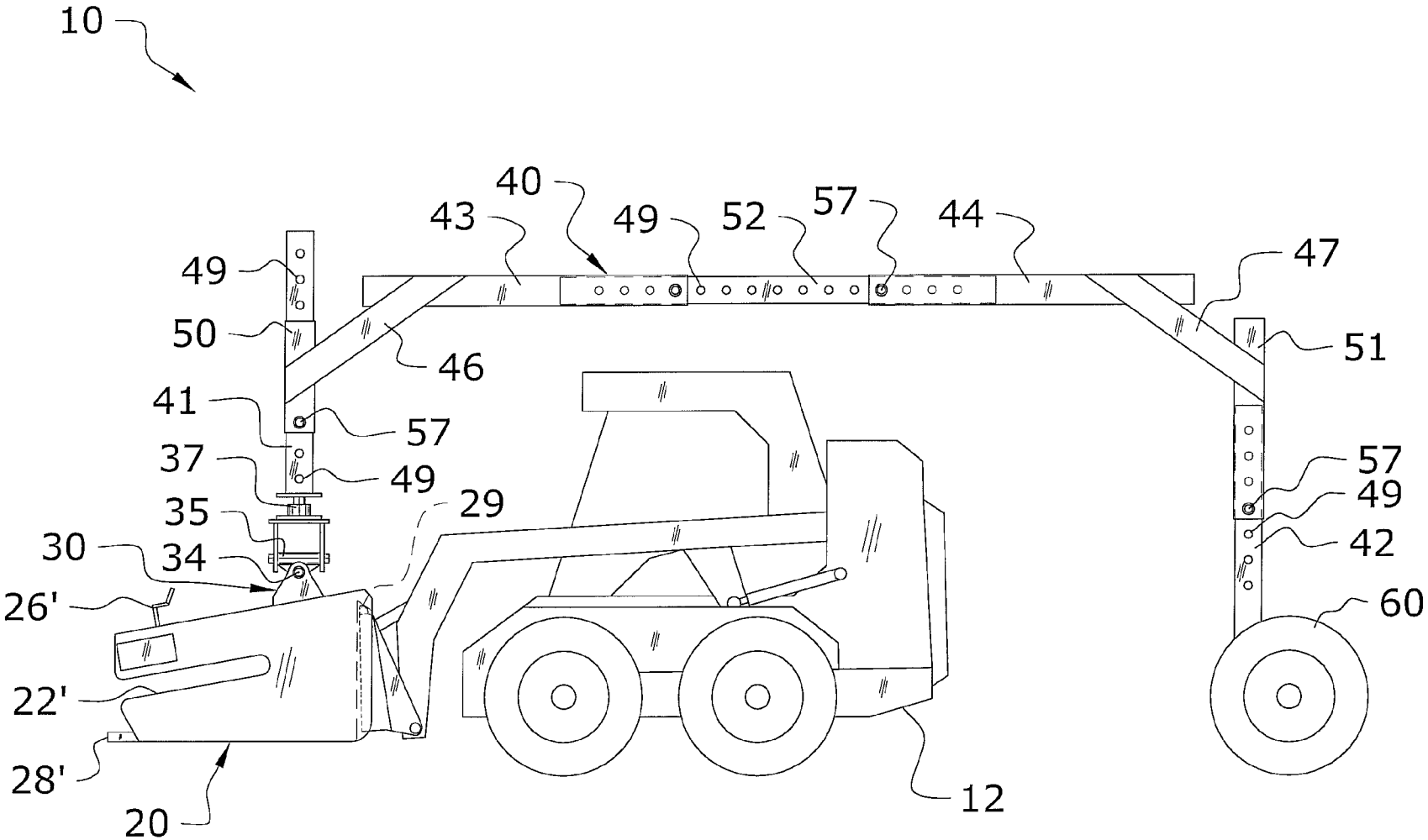
FIG. 5 is a side view of the present invention attached to a skid steer loader utilizing a third method of attachment.

The attachment assembly 20 may attach to the skid steer loader 12 by a plurality of methods as illustrated in FIGS. 3 through 5. A first method of attachment for attaching the attachment assembly 20 to the skid steer loader 12 is utilized when a bucket 14 is presently attached to the arms of the skid steer loader 12. The front of the bucket 14 is slidably positioned within the slots 22, 22' of the attachment assembly 20 as shown in FIG. 3. The centering members 25, 25' are then preferably extended from opposing sides of the cross member 24 and engaged against the inner side of the sidewalls of the bucket 14. The centering members 25, 25' are further adjusted until the attachment assembly 20 is centered within the bucket 14. The securing members 26, 26' may now be extended through the openings 14 of the bucket 14 thus securing the attachment assembly 20 within the bucket 14.

A second method of attachment for attaching the attachment assembly 20 to the skid steer loader 12 is utilized when a fork unit 17 is presently attached to the arms of the skid steer loader 12. The fork unit 17 of the skid steer loader 12 is slidably positioned within the channel members 28, 28' of the attachment assembly 20 as shown in FIG. 4.

A third method of attachment is to attach the attachment assembly 20 directly to the arms of the skid steer loader 12 via the loader attachment mechanism 29 as shown in FIG. 5. The loader attachment mechanism 29 is preferably comprised of a quick attach method of attachment common in the art of skid steer loaders 12 and described in U.S. Pat. No. 3,984,016. The loader attachment mechanism 29 includes a member to lock down a lift arm of the skid steer loader 12 and a hook can be attached to the skid steer loader 12 and a hook attached to the attachment assembly 20. It is appreciated that various methods of attachment of the attachment assembly 20 to the skid steer loader 12 may be utilized with the present invention rather than the described methods.

C. Knuckle Assembly

Figure 6:
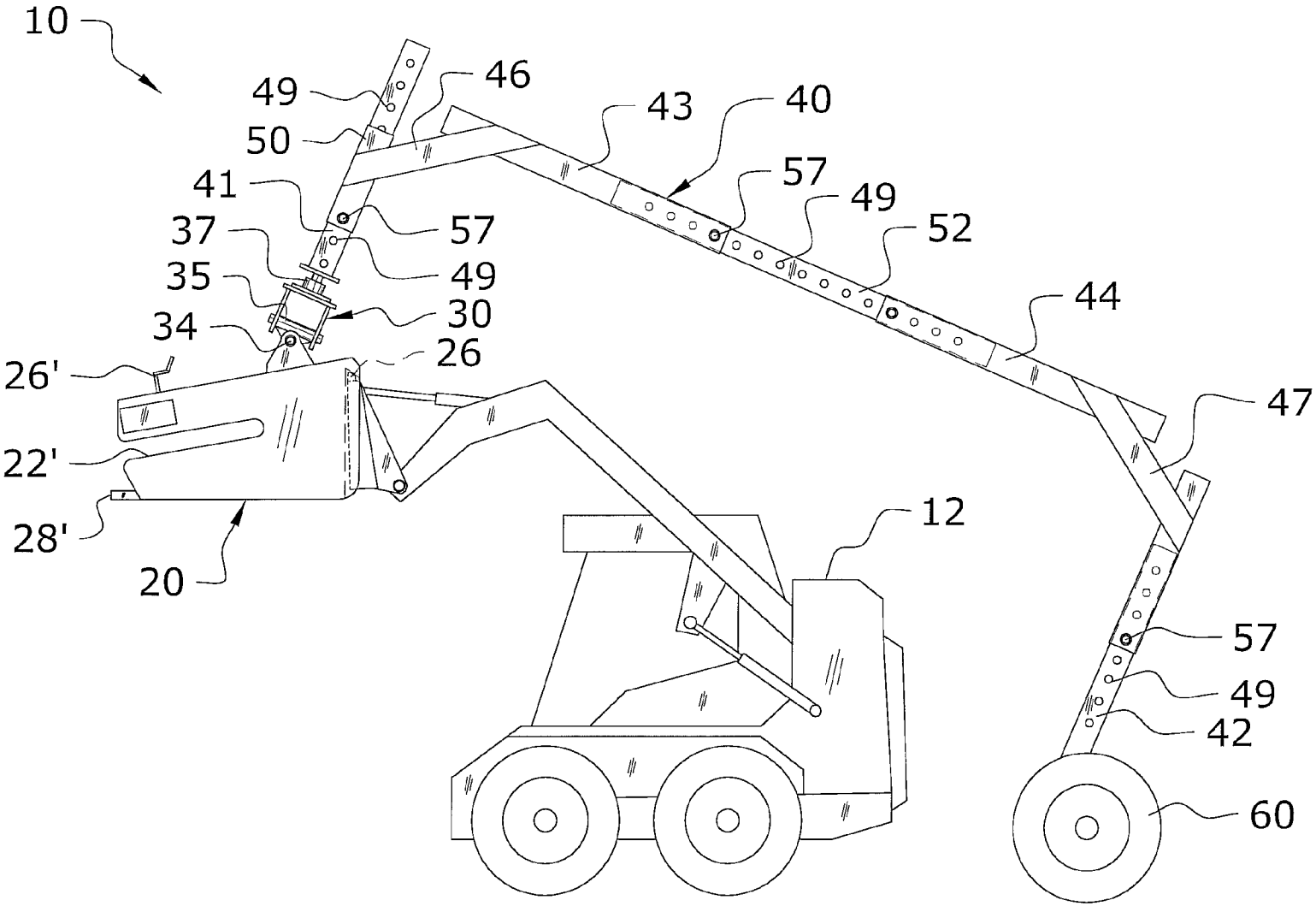
FIG. 6 is a side view of the present invention attached to a skid steer loader with the present invention pivoted about the rear wheel.
Figure 7:
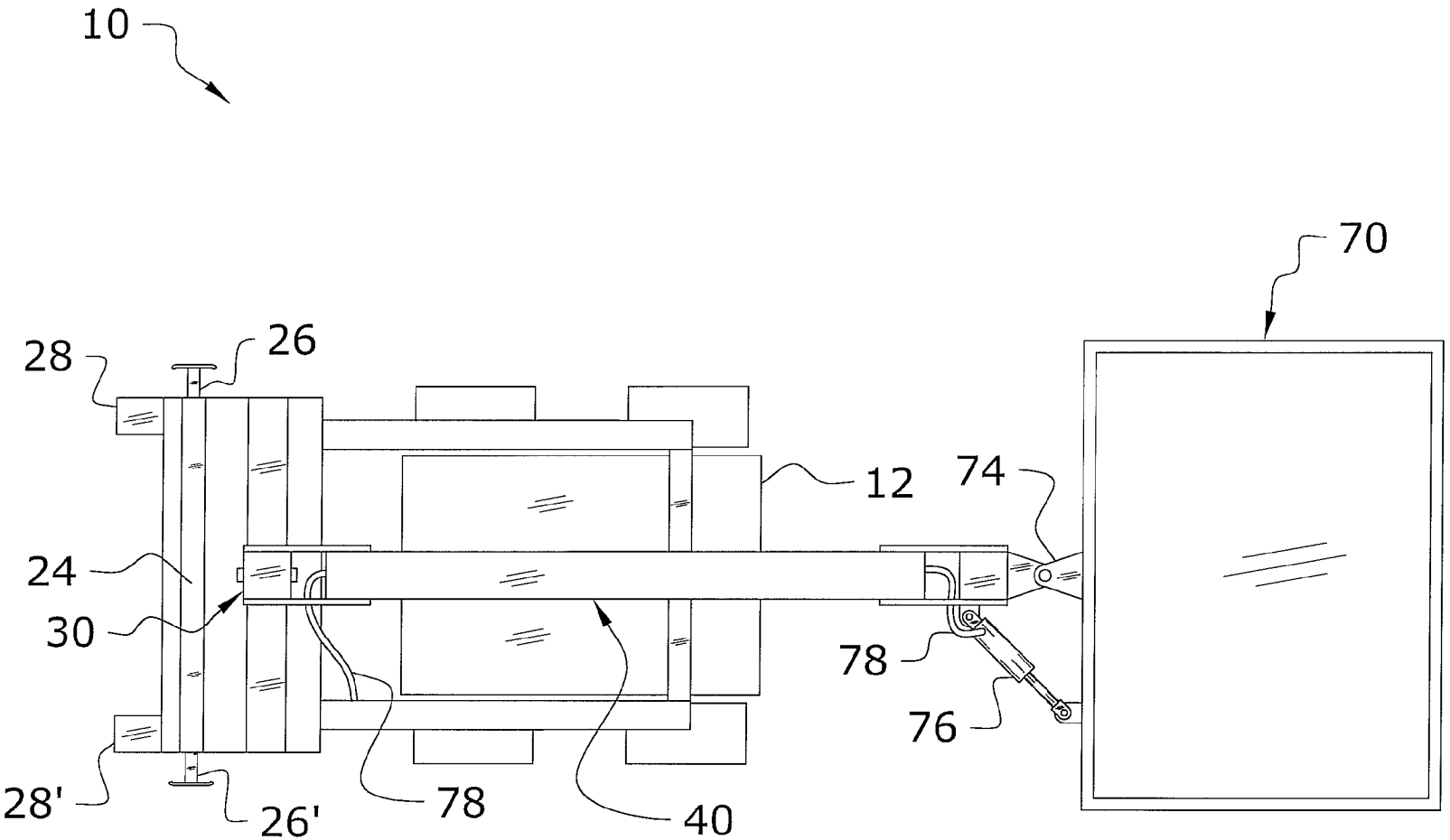
FIG. 7 is a top view of the present invention attached to a skid steer loader with the present invention utilizing a trailer attachment.

A knuckle assembly 30 is preferably attached between the attachment assembly 20 and the support frame 40 as shown in FIG. 1. The knuckle assembly 30 allows the support frame 40 to swivel or rotate about the attachment assembly 20 and skid steer loader 12 as illustrated in FIGS. 6, 8, 9 and 10. The knuckle assembly 30 also allows the support frame 40 to be pivoted about the wheel 60 when the present invention is raised upwards or lowered by the arms of the skid steer loader 12 as shown in FIG. 6. The knuckle assembly 30 further prevents the support frame 40 from laterally swaying when mechanically attached to the skid steer loader 12.

The knuckle assembly 30 preferably includes a first rotator member 32 and a second rotator member 37. The first rotator member 32 also preferably includes a first swivel portion 34 and the second rotator member 37 preferably includes a second swivel portion 35 as illustrated in FIG. 1. The first rotator member 32 is mechanically attached to the upper end of the attachment assembly 20, wherein the first swivel portion 34 is adjacent to the second swivel portion 35. The first rotator member 32 is preferably able to rotate 360 degrees about the attachment assembly 20.

Figure 8:
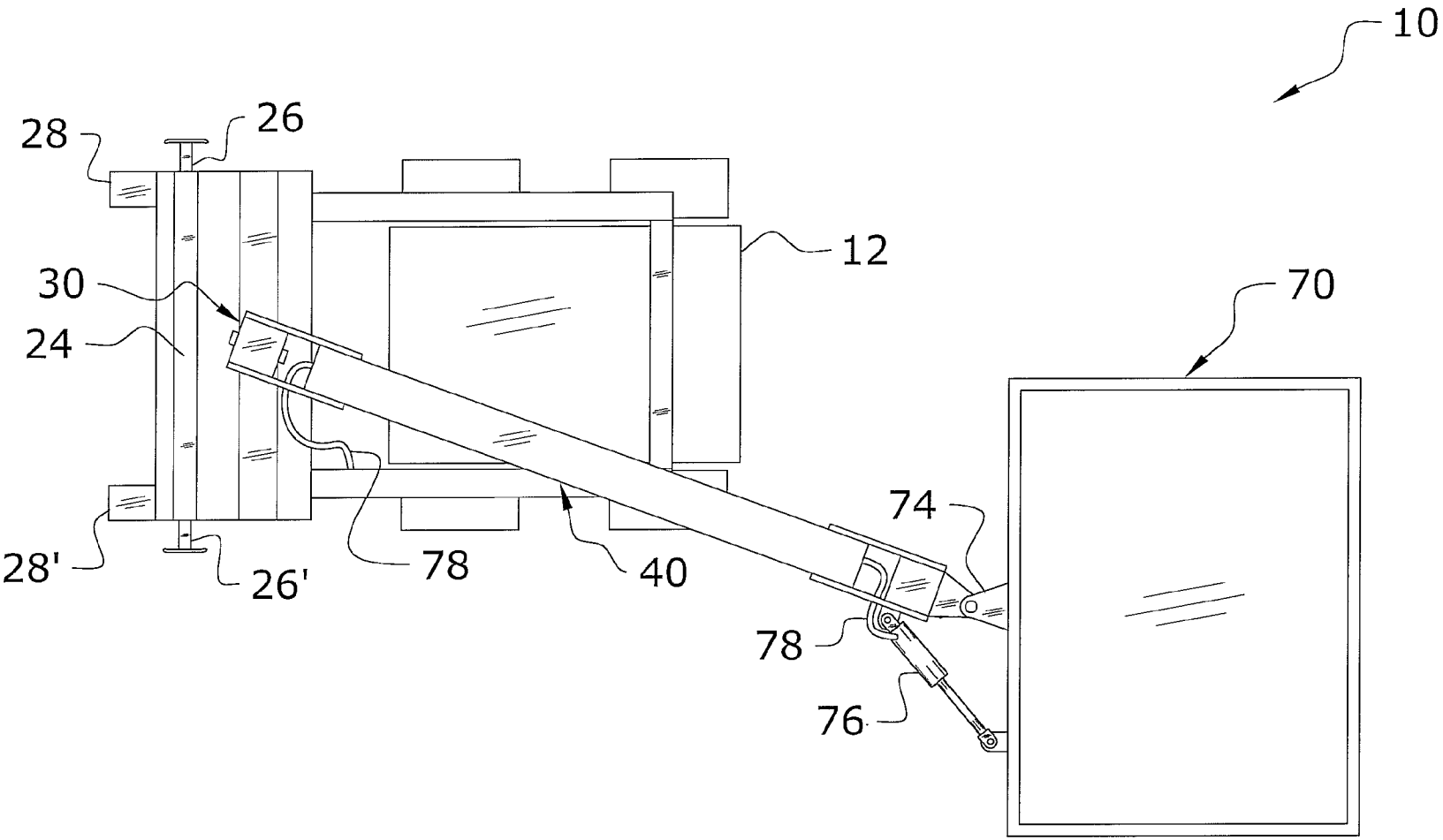
FIG. 8 is a top view of the present invention attached to a skid steer loader with the present invention utilizing a trailer attachment and the trailer attachment being pivoted in a first direction.
Figure 9:
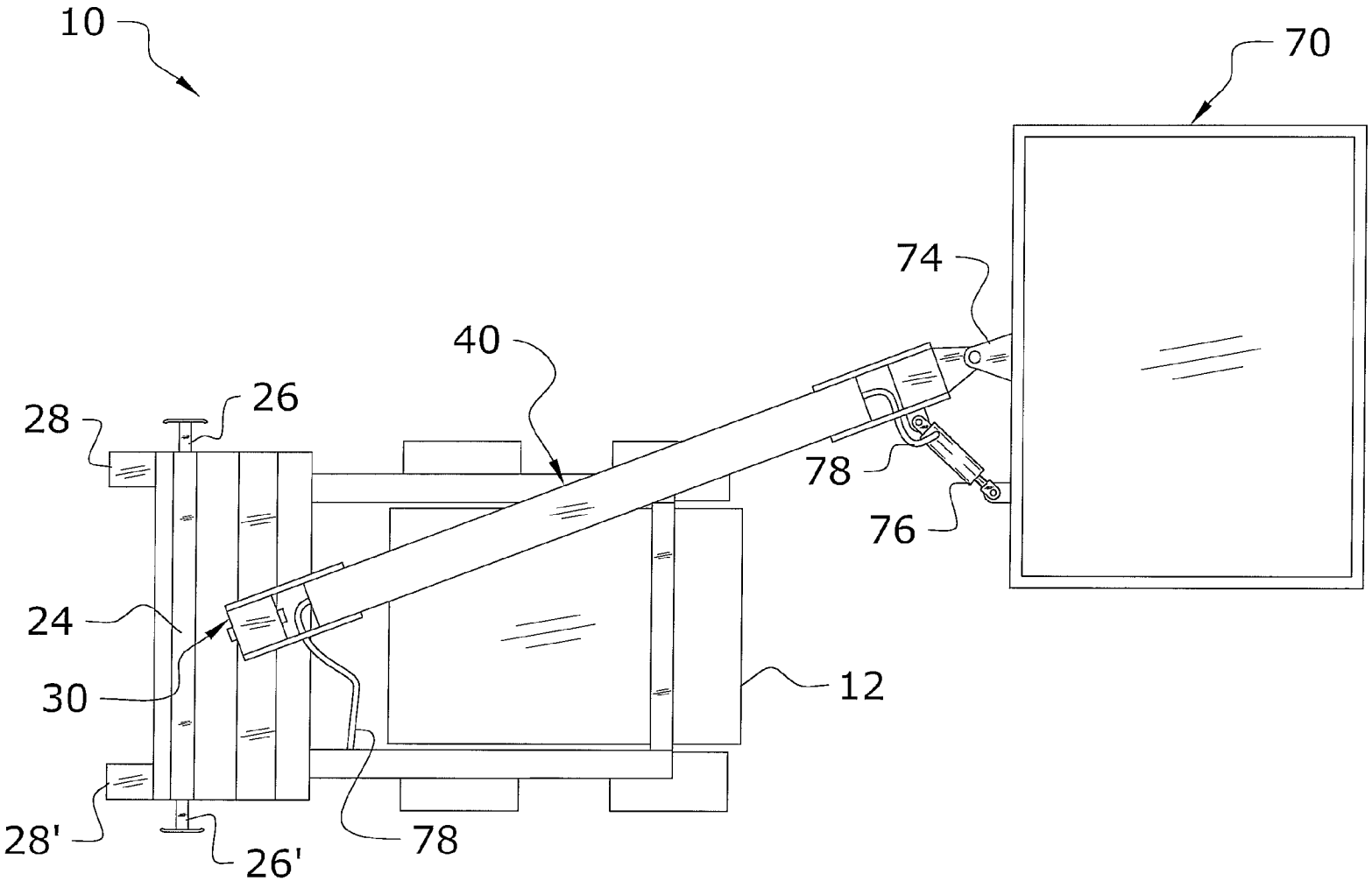
FIG. 9 is a top view of the present invention attached to a skid steer loader with the present invention utilizing a trailer attachment and the trailer attachment being pivoted in a second direction.
Figure 10:
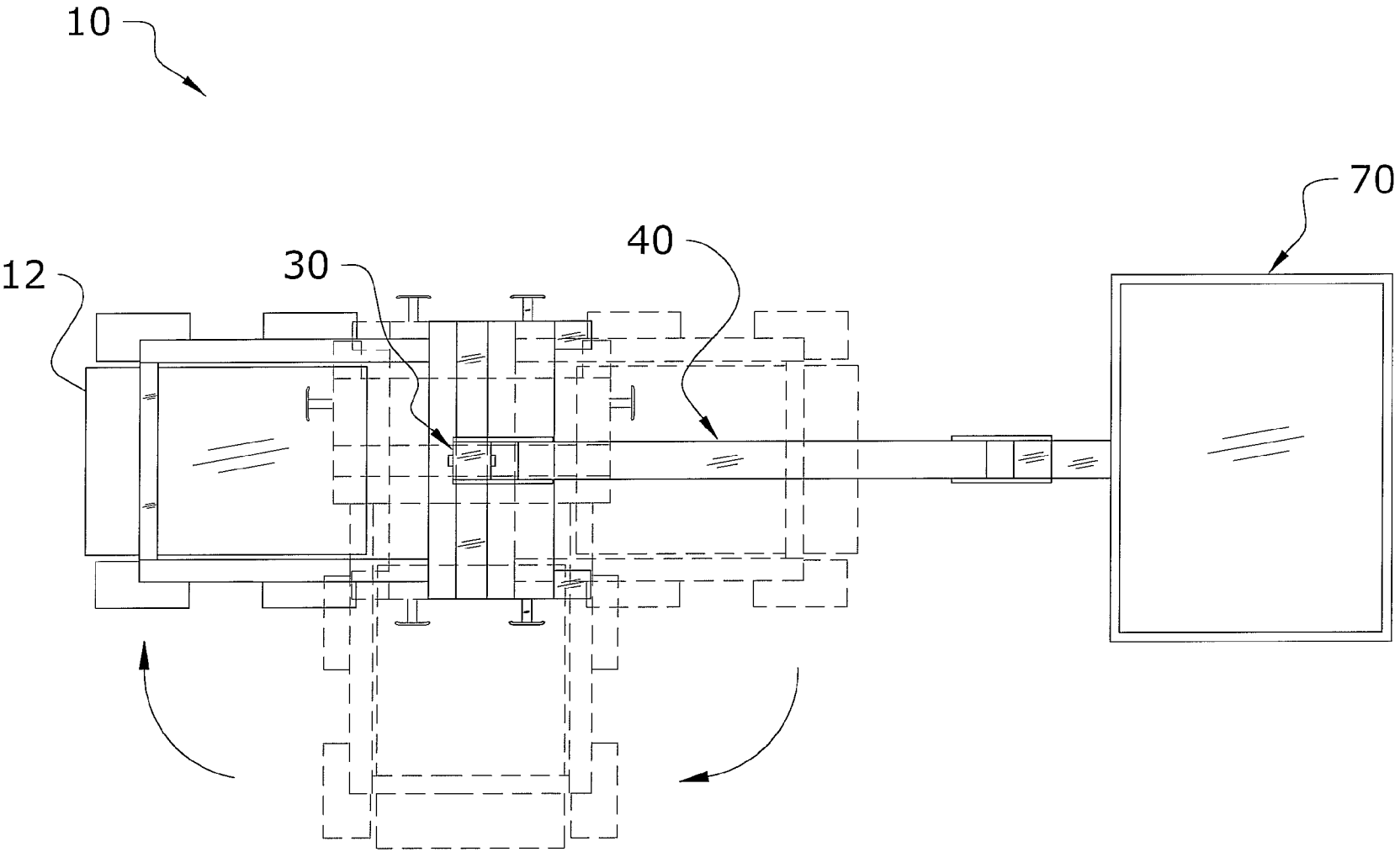
FIG. 10 is a top view of the present invention attached to a skid steer loader with skid steer loader being rotated 180 degrees about the present invention.
Figure 13:
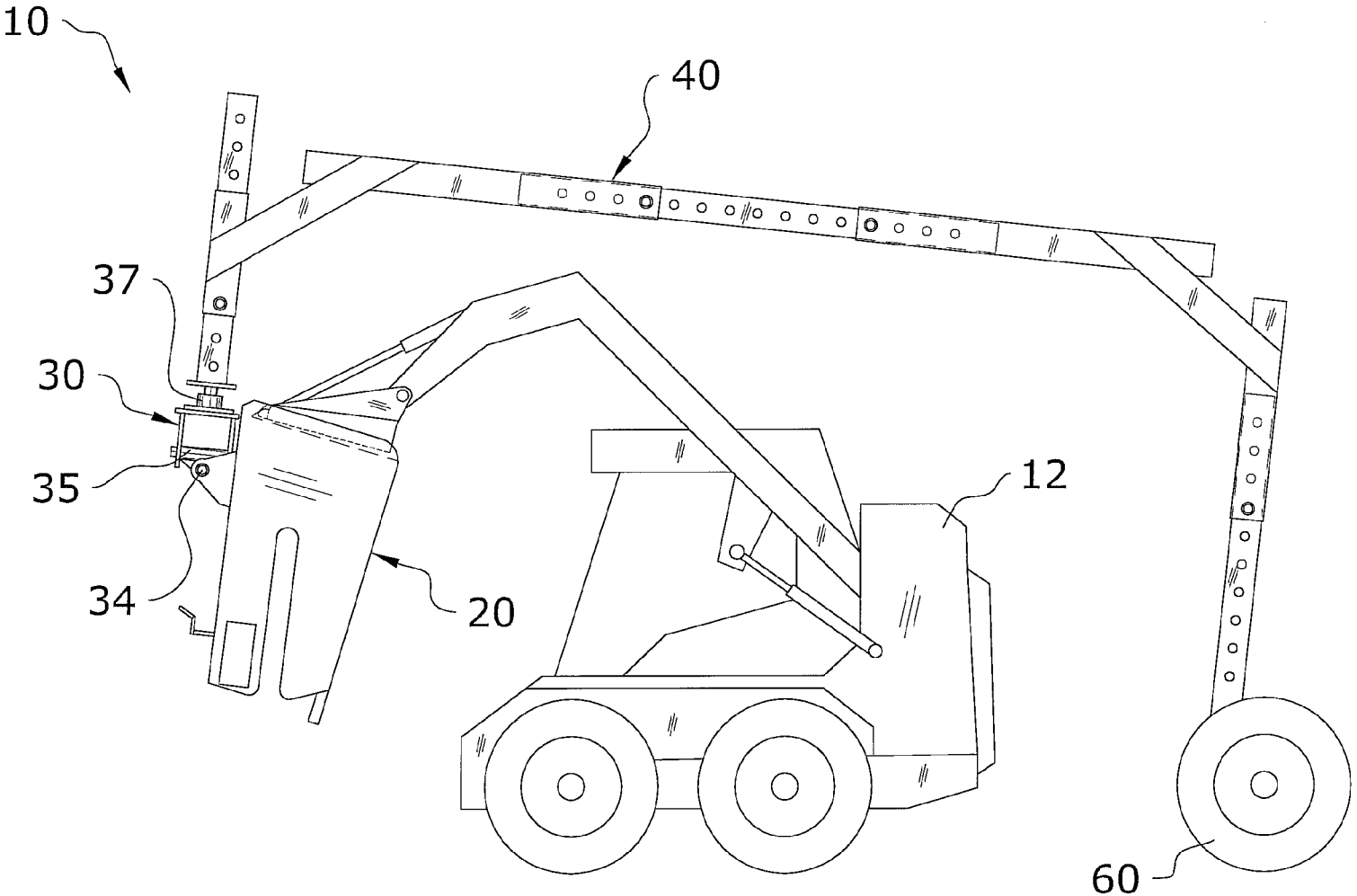
FIG. 13 is a side view of the present invention attached to a skid steer loader with the attachment assembly curled forward.

The second rotator member 37 is mechanically attached to the upper end of the first rotator member 32 via attachment of the second swivel portion 35 to the first swivel portion 34, wherein the second swivel portion 35 is adjacent to the first swivel portion 34. The second rotator member 37 is preferably able to rotate 360 degrees about the first rotator member 32. The first swivel portion 34 and the second swivel portion 35 also preferably form a U-joint structure and are able to pivot about one another as illustrated in FIGS. 8 through 10. The second rotator member 37 also allows the attachment assembly 20 to be curled forward as illustrated in FIG. 13.

The first rotator member 32 and first swivel portion 34 are further preferably positioned perpendicular to the second rotator member 37 and the second swivel portion 35 as illustrated in FIGS. 1 and 2. The perpendicular orientation of the first rotator member 32 to the second rotator member 37 preferably forms a dual axis rotation about the first swivel portion 34 and the second swivel portion 35 to allow for greater maneuverability of the support frame 40.

It is appreciated that the knuckle assembly 30 may be comprised of various configurations and structures all which allow the support frame 40 to rotate about the attachment assembly 20 and the skid steer loader 12. It is also appreciated that the knuckle assembly 30 may be omitted from the present invention if the support frame 40 is meant to be fixedly attached to the attachment assembly 20.

D. Support Frame

The support frame 40 is preferably attached to the knuckle assembly 30 and is rotatable about the attachment assembly 20 and the skid steer loader 12, wherein the support frame 40 is able to rotate 360 degrees around the skid steer loader 12. The support frame 40 is comprised of an inverted U-shaped configuration as shown in FIGS. 3 through 6. The support frame 40 is preferably comprised of a metal material; however it is appreciated that the support frame 40 may be comprised of various configurations rather than the preferred embodiment, such as but not limited to plastic or wood.

The support frame 40 is preferably comprised of a square tubular configuration; however it is appreciated that various configurations may be utilized with the support frame 40. The gap between the parallel portions of the U-shaped configuration is also large enough to accommodate the skid steer loader 12, wherein the skid steer loader 12 may be positioned within the gap formed by the parallel portions as shown in FIGS. 3 through 6.

The support frame 40 includes a first support member 41 mechanically attached to the knuckle assembly 30 a second support member 42 mechanically attached to the wheels 60 and a third support member 43 and a fourth support member 44 mechanically attached between thereof as shown in FIGS. 3 through 6. The first support member 41 preferably extends upwardly from the second rotator member 37 opposite the second swivel portion 35. The first support member 41 is further preferably perpendicularly oriented to the ground surface as illustrated in FIGS. 3 through 6.

The first support member 41 also preferably includes a plurality of apertures 49 extending through opposing sides of the first support member 41 along a longitudinal axis of the first support member 41. The apertures 49 are preferably spaced equidistant apart.

The support frame 40 also preferably includes a first adjustment member 50 telescopingly attached to the first support member 41 as shown in FIGS. 3 through 6. The first adjustment member 50 allows the user to adjust the height of a first end of the support frame 40 to ensure that the support frame 40 may be rotated around and over the skid steer loader 12 as illustrated in FIGS. 3 through 6.

The first adjustment member 50 also preferably includes an aperture 49 extending through opposing sides of the first adjustment member 50. A fastener 57 is received by the aperture 49 of the first adjustment member and the desired apertures 49 of the first support member when a desired height is reached of the first end of the support frame 40.

Extending from a side of the first adjustment member 50 adjacent to the skid steer loader 12 is preferably a first connecting member 46. The first connecting member 46 preferably extends at a substantially 45 degree upward angle to provide added support for the support frame 40. The opposing end of the first connecting member 46 as the first adjustment member 50 is preferably attached to the third support member 43.

The third support member 43 is further preferably oriented parallel to the ground surface as illustrated in FIGS. 3 through 6. The third support member 43 also preferably includes an aperture 49 extending through opposing sides of the first support member 41. The fourth support member 44 is also preferably oriented parallel to the ground surface as illustrated in FIGS. 3 through 6. The fourth support member 44 also preferably includes an aperture 49 extending through opposing sides of the first support member 41.

The support frame 40 also preferably includes a third adjustment member 52 telescopingly attached to the third support member 43 and the fourth support member 44 as shown in FIGS. 3 through 6. The third adjustment member 52 allows the user to adjust the length of the support frame 40 to ensure that the support frame 40 may be rotated around and over the skid steer loader 12 as illustrated in FIGS. 3 through 6.

The third adjustment member 52 also preferably includes a plurality of apertures 49 extending through opposing sides of the third adjustment member 52 along a longitudinal axis of the third adjustment member 52 as illustrated in FIGS. 3 through 6. The apertures 49 are preferably spaced equidistant apart and align with the apertures 49 of the third support member 43 and the fourth support member 44. A fastener 57 is received by the apertures 49 of the third adjustment member and the desired aperture 49 of the support members 43, 44 when a desired length is reached about the support frame 40.

Extending from a lower side of the fourth adjustment member opposite the third support member 43 is preferably a second connecting member 47. The second connecting member 47 preferably extends at a substantially 45 degree downward angle to provide added support for the support frame 40.

The opposing end of the second connecting member 47 as the fourth adjustment member is preferably attached to the second adjustment member 51.

The second adjustment member 51 is preferably perpendicularly oriented to the ground surface as illustrated in FIGS. 3 through 6. The second adjustment member 51 extends substantially downward from the second connecting member 47. The second adjustment member 51 also preferably includes an aperture 49 extending through opposing sides of the first adjustment member 51.

The support frame 40 also preferably includes the second support member 42 telescopingly attached to the second adjustment member 51 as shown in FIGS. 3 through 6. The telescoping attachment of the second adjustment member 51 to the second support member 42 allows the user to adjust the height of a second end of the support frame 40 to ensure that the support frame 40 may be rotated around and over the skid steer loader 12 as illustrated in FIGS. 3 through 6.

The second support member 42 also preferably includes a plurality of apertures 49 extending through opposing sides of the second support member 42 along a longitudinal axis of the second support member 42 as illustrated in FIGS. 3 through 6. The apertures 49 are preferably spaced equidistant apart and align with the aperture 49 of the second adjustment member 51. A fastener 57 is received by the aperture 49 of the second adjustment member 51 and the desired aperture 49 of the second support member 42 when a desired height is reached of the second end of the support frame 40.

It is appreciated that the support frame 40 may be comprised of various configurations rather than the preferred embodiment. It is also appreciated that the support frame 40 is preferably comprised of a plurality of separate structures to allow for adjustment of the support frame 40; however the support frame 40 may be comprised of an integrally formed structure. The support frame 40 may also incorporate various methods of adjustment rather than the telescoping method of adjustment.

E. Attachment Unit

The wheels 60 are mechanically attached to the second support member 42 of the support frame 40. The wheels 60 are further mechanically attached to an axle connecting the wheels 60, wherein the axle is rotatably attached to the second support member 42 of the support frame 40. It is appreciated that the present invention may includes a various number of wheels 60 depending on the particular application that the present invention is utilized for (i.e. hauling objects, pulling objects, plowing, etc.).

Figure 11:
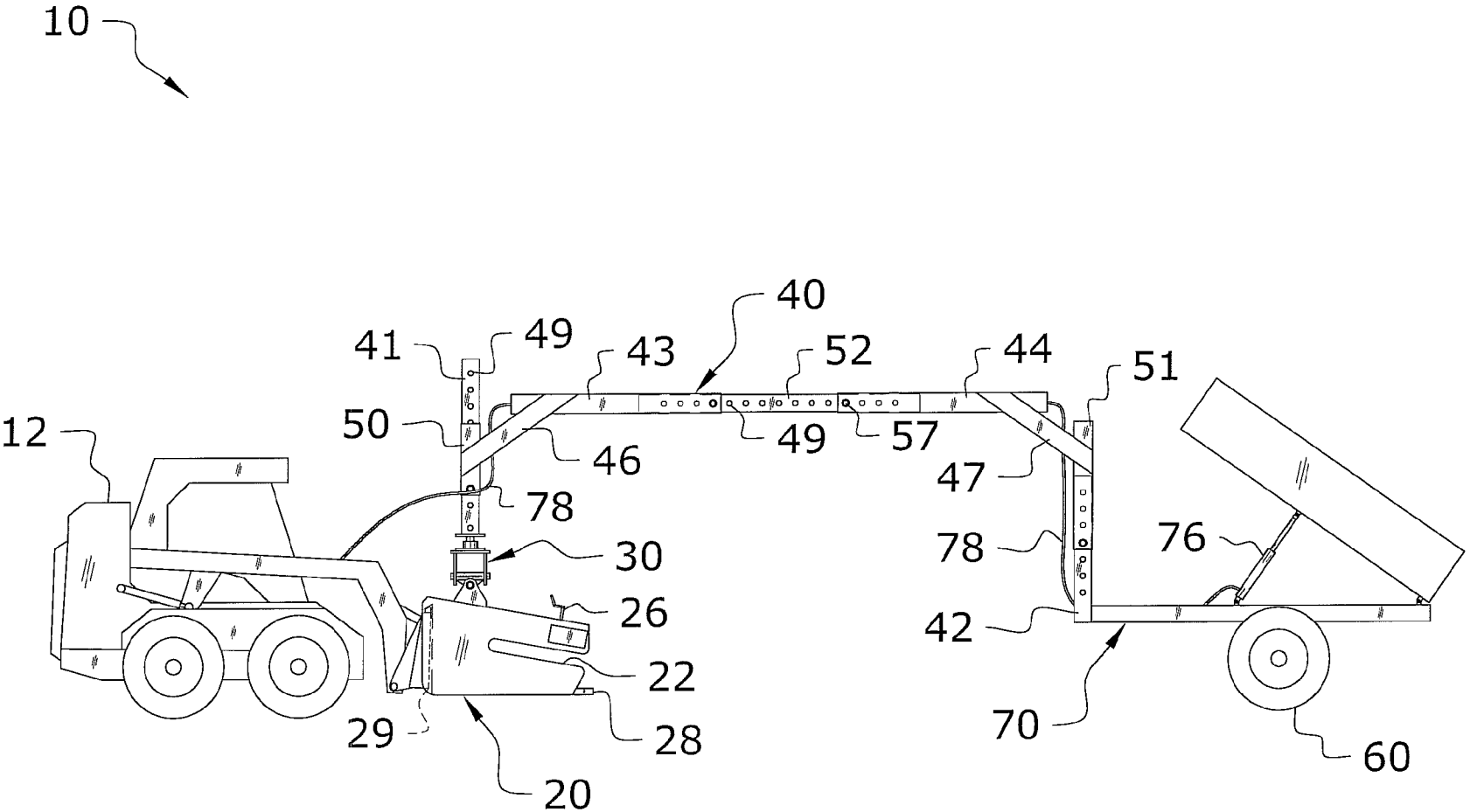
FIG. 11 is a side view of the present invention attached to a skid steer loader with the present invention positioned in front of the skid steer loader and a dump box attachment being utilized.

An attachment unit 70 may be attached to the second support member 42 as shown in FIG. 11. The attachment unit 70 may be comprised of various configurations, such as but not limited to a plow, a flatbed trailer or a partially/fully enclosed trailer. The attachment unit 70 may also be pivotally attached to the third support member 42 via a pivot unit 74 mechanically attached between the attachment unit 70 and the third support member 42.

The pivot axis of the pivot unit 74 is preferably perpendicularly oriented with the ground plane to allow the attachment unit 70 to pivot from side to side and to allow the support frame 40 and attachment unit 70 to be rotated about the skid steer loader 12 as illustrated in FIGS. 8 and 9. The side to side pivoting of the attachment unit 70 may be desirable in such instances as row crop farming, brush mowers and extrusion of cement curbs. The side to side pivoting of the attachment unit 70 functions similar to a conventional crab steering mechanism.

The attachment unit 70 may also be mechanically attached to an actuator device 76. The actuator device 76 is preferably comprised of a hydraulic actuator, wherein the actuator is hydraulically connected to the skid steer loader 12 via at least one hydraulic hose 78. Additional actuators may also be mechanically attached upon an underside of the attachment unit 70, wherein the actuators pivot the attachment unit 70 about the axle of the wheels 60 and the attachment unit 70 is utilized as a dump box configuration.

Figure 12:
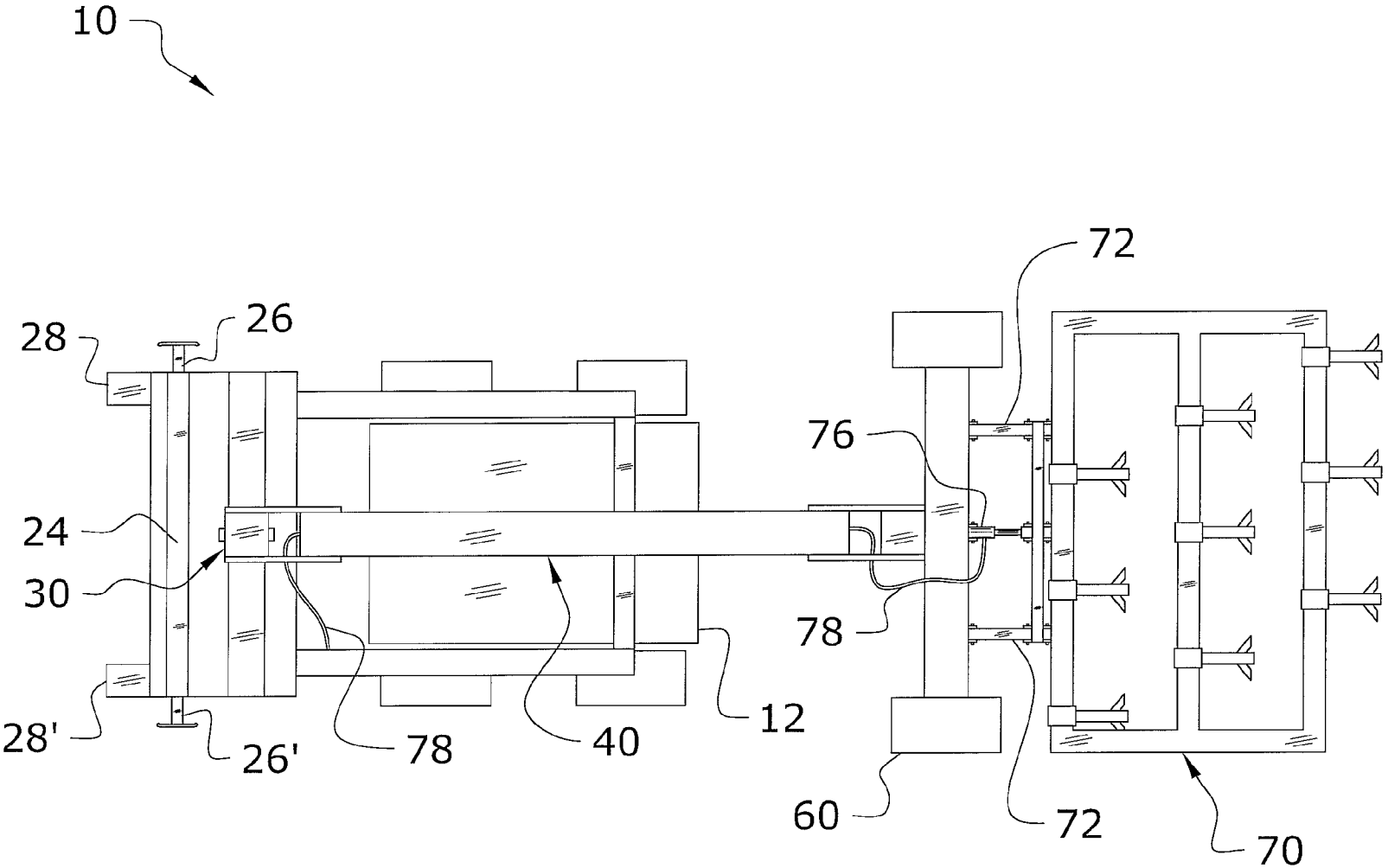
FIG. 12 is a top view of the present invention attached to a skid steer loader with the present invention utilizing a three point hitch and a cultivator attachment.

The attachment unit 70 may also be comprised of a standard plow configuration with a standard three point hitch assembly as shown in FIG. 12. The third support member 43 would thus include a hitch unit 72, wherein the hitch unit 72 is comprised of a three point hitch unit 72 and attaches to the three point hitch assembly of the plow. It is appreciated that various three point hitch attachments may thus attach to the hitch unit 72 of the present invention.

The three point hitch is also preferably comprised of a three point hitch common in the art of tractors and the like. The three point hitch may also be comprised of a farm implement ASAE category 1, 2 or 3 hitch assembly. Various other attachments may be utilized with the present invention, rather than the described embodiments, wherein the various attachment units 70 are generally comprised of a pull behind attachment unit 70 (i.e. trailer, plow, etc.).

F. In Use

In use, the assembled attachment assembly 20, knuckle assembly 30, support frame 40 and desired attachment unit 70 are attached to the skid steer loader 12 via attaching the attachment assembly 20 to the front of the skid steer loader 12 preferably utilizing one of the described methods. If the actuator devices 76 are utilized with the attachment unit 70, the hydraulic hoses 78 are preferably attached to the skid steer loader 12 and then the actuator devices 76.

Excess hydraulic hose 78 is preferably attached to the support frame 40 to prevent the excess hydraulic hose 78 from becoming entangled while utilizing the present invention. It is appreciated that the hydraulic hoses 78 may also be positioned within the interior of the support frame 40. The operator may now operate the skid steer loader 12 and the present invention accordingly with utilized attachment unit 70.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A skid steer attachment system, comprising:

an attachment assembly, wherein said attachment assembly is mechanically attached to a skid steer vehicle;

a support frame mechanically attached to said attachment assembly, wherein said support frame is comprised of a U-shaped structure;

at least one wheel rotatably attached to said support frame opposite said attachment assembly, wherein said at least one wheel is positionable upon an opposing side of said skid steer vehicle as said attachment assembly;

a platform attached to said support frame adjacent said at least one wheel, wherein said platform is pivotally attached to said support frame; and at least one actuator device attached between said platform and said support frame, wherein said at least one actuator device pivotally adjusts said platform.

2. The skid steer attachment system of claim 1, including a knuckle assembly mechanically attached between said attachment assembly and said support frame.

3. The skid steer attachment system of claim 2, wherein said support frame rotates about said attachment assembly via a first pivot axis of said knuckle assembly.

4. The skid steer attachment system of claim 3, wherein said support frame rotates about said attachment assembly via a second pivot axis of said knuckle assembly, wherein said second pivot axis is substantially perpendicular to said first pivot axis.

5. The skid steer attachment system of claim 2, wherein said support frame rotates 360 degrees about said skid steer vehicle via said knuckle assembly.

6. The skid steer attachment system of claim 1, wherein said support frame includes a first support member mechanically attached to said attachment assembly, a second support member mechanically attached to said at least one wheel and a third support member mechanically attached between thereof wherein said first support member, said second support member and said third support member form said U-shaped structure.

7. The skid steer attachment system of claim 6, wherein said first support member and said second support member are substantially perpendicular to a ground plane and wherein said third support member is substantially parallel to said ground plane.

8. The skid steer attachment system of claim 6, wherein a first longitudinal axis of said first support member and a second longitudinal axis of said second support member are substantially perpendicular to a third longitudinal axis of said third support member.

9. The skid steer attachment system of claim 6, wherein a distance from of said third support member to a ground surface is greater than a height of said skid steer vehicle.

10. The skid steer attachment system of claim 1, wherein a third pivot axis of said platform is perpendicular to a ground plane.

11. The skid steer attachment system of claim 1, wherein a fourth pivot axis of said platform is parallel to a ground plane.

12. The skid steer attachment system of claim 1, including a three point hitch attached to said support frame adjacent said at least one wheel.

13. The skid steer attachment system of claim 1, wherein said attachment assembly includes a pair of channel members extending across said attachment assembly, wherein said pair of channel members slidably attach to a fork unit of said skid steer vehicle.

14. The skid steer attachment system of claim 1, wherein said attachment assembly includes a pair of slots extending within a pair of opposing side portions of said attachment assembly, wherein said pair of slots slidably attach to a bucket of said skid steer vehicle.

15. A skid steer attachment system, comprising:

an attachment assembly to mechanically attach to a skid steer vehicle;

a support frame mechanically attached to said attachment assembly, wherein said support frame is comprised of a U-shaped structure; and at least one wheel rotatably attached to said support frame opposite said attachment assembly, wherein said at least one wheel is positionable upon an opposing side of said skid steer vehicle as said attachment assembly;

wherein said support frame includes a first support member mechanically attached to said attachment assembly, a second support member mechanically attached to said at least one wheel and a third support member mechanically attached between thereof wherein said first support member, said second support member and said third support member form said U-shaped structure;

wherein said first support member and said second support member are substantially perpendicular to a ground plane and wherein said third support member is substantially parallel to said ground plane;

wherein a first longitudinal axis of said first support member and a second longitudinal axis of said second support member are substantially perpendicular to a third longitudinal axis of said third support member;

wherein a distance from of said third support member to a ground surface is greater than a height of said skid steer vehicle;

a knuckle assembly mechanically attached between said attachment assembly and said support frame;

wherein said support frame rotates about said attachment assembly via a first pivot axis of said knuckle assembly;

wherein said support frame rotates about said attachment assembly via a second pivot axis of said knuckle assembly and wherein said second pivot axis is substantially perpendicular to said first pivot axis.

16. A skid steer attachment system, comprising:

an attachment assembly to mechanically attach to a skid steer vehicle;

a support frame mechanically attached to said attachment assembly, wherein said support frame is comprised of a U-shaped structure;

at least one wheel rotatably attached to said support frame opposite said attachment assembly, wherein said at least one wheel is positionable upon an opposing side of said skid steer vehicle as said attachment assembly;

wherein said support frame includes a first support member mechanically attached to said attachment assembly, a second support member mechanically attached to said at least one wheel and a third support member mechanically attached between thereof wherein said first support member, said second support member and said third support member form said U-shaped structure;

wherein said first support member and said second support member are substantially perpendicular to a ground plane and wherein said third support member is substantially parallel to said ground plane;

wherein a first longitudinal axis of said first support member and a second longitudinal axis of said second support member are substantially perpendicular to a third longitudinal axis of said third support member;

wherein a distance from of said third support member to a ground surface is greater than a height of said skid steer vehicle; and a knuckle assembly mechanically attached between said attachment assembly and said support frame;

wherein said support frame rotates about said attachment assembly via a first pivot axis of said knuckle assembly;

wherein said support frame rotates about said attachment assembly via a second pivot axis of said knuckle assembly, wherein said second pivot axis is substantially perpendicular to said first pivot axis;

wherein said support frame rotates 360 degrees about said skid steer vehicle via said knuckle assembly;

wherein said attachment assembly includes a pair of channel members extending across said attachment assembly;

wherein said attachment assembly includes a pair of slots extending within a pair of opposing side portions of said attachment assembly.

17. A skid steer attachment system, comprising:

an attachment assembly, wherein said attachment assembly is mechanically attached to a front end of skid steer vehicle;

a universal joint connected to said attachment assembly;

a support frame mechanically attached to said universal joint opposite of said attachment assembly, wherein said support frame is comprised of a U-shaped structure capable of allowing said skid steer vehicle to pass beneath and through an opening within the U-shaped structure;

wherein said support frame rotates 360 degrees about said skid steer vehicle via said universal joint;

at least one wheel rotatably attached to said support frame opposite said attachment assembly, wherein said at least one wheel is positionable upon an opposing side of said skid steer vehicle as said attachment assembly.

18. The skid steer attachment system of claim 1, wherein said attachment assembly includes a pair of channel members extending across said attachment assembly, wherein said pair of channel members slidably attach to a fork unit of said skid steer vehicle.

19. The skid steer attachment system of claim 1, wherein said attachment assembly includes a pair of slots extending within a pair of opposing side portions of said attachment assembly, wherein said pair of slots slidably attach to a bucket of said skid steer vehicle.

* * * * *